US006501427B1

(12) United States Patent
Lilly et al.

(10) Patent No.: US 6,501,427 B1
(45) Date of Patent: Dec. 31, 2002

(54) TUNABLE PATCH ANTENNA

(75) Inventors: James D. Lilly, Silver Spring, MD (US); William E. McKinzie, III, Fulton, MD (US); Greg Mendolia, Ellicott City, MD (US); Andrew Humen, Jr., Croston, MD (US)

(73) Assignee: e-Tenna Corporation, Del Mar, CA (US)

( * ) Notice: Subject to any disclaimer, the term of this patent is extended or adjusted under 35 U.S.C. 154(b) by 0 days.

(21) Appl. No.: 09/919,776

(22) Filed: Jul. 31, 2001

(51) Int. Cl.[7] ..... H01Q 1/38
(52) U.S. Cl. ..... 343/700 MS; 333/33
(58) Field of Search ..... 343/700 MS, 745, 343/846, 848, 815, 816, 817, 818; 333/33

(56) References Cited

U.S. PATENT DOCUMENTS

| | | | | | |
|---|---|---|---|---|---|
| 4,379,296 | A | * | 4/1983 | Farrar et al. | 343/700 MS |
| 4,700,194 | A | * | 10/1987 | Ogawa et al. | 343/700 MS |
| 5,777,581 | A | | 7/1998 | Lilly et al. | 343/700 |
| 5,943,016 | A | | 8/1999 | Snyder, Jr. et al. | 343/700 |
| 6,061,025 | A | | 5/2000 | Jackson et al. | 343/700 |
| 6,198,438 | B1 | * | 3/2001 | Herd et al. | 343/700 MS |
| 6,351,247 | B1 | * | 2/2002 | Linstrom et al. | 342/368 |

FOREIGN PATENT DOCUMENTS

| | | |
|---|---|---|
| EP | 0 646 983 | 4/1995 |
| EP | 1 014 487 | 6/2000 |

OTHER PUBLICATIONS

W. Weedon et al., "MEMS–Switched Reconfigurable Multi –Band Antenna: Design and Modeling," Proc. of 1999 Antenna Applications Symposium, Sep. 15–17, 1999.

W. Payne et al., "Stripline Feed Networks for Reconfigurable Patch Antennas," 2000 Antenna Applications Symposium, Sep. 20–22, 2000.

W. Weedon et al., "MEMS–Switched Reconfigurable Antennas," 2001 IEEE Antennas and Propagation Society Int'l Symposium, Jul. 8–13, 2001.

D. Linden, "A System for Evolving Antennas In–Situ," NASA/DoD Evolvable Hardware Conference, Jul. 2001.

* cited by examiner

*Primary Examiner*—Tan Ho
(74) *Attorney, Agent, or Firm*—Pillsbury Winthrop LLP

(57) ABSTRACT

A patch antenna is composed of a segmented patch and MEMS switches which are built on a substrate. The patch segments of the segmented patch can be electrically connected to each other by the MEMS switches to form a contiguous patch and optional tuning strips and to connect or block RF between the contiguous patch and the optional tuning strips. When RF is connected between the tuning strips and the contiguous patch, the tuning strips increase the effective length of the contiguous patch and lower the antenna's resonant frequency, thereby allowing the antenna to be frequency tuned electrically over a relatively broadband of frequencies. When the tuning strips are connected to the patch in other than a symmetrical pattern, the antenna pattern of the antenna can be changed. In another aspect of the invention, the optional tuning strips are continuous structures that are formed by connecting patch segments using switches. A planar inverted F antenna (PIFA) is also provided with one or more tuning strips spaced from the lid of the PIFA and with switches to connect or block RF between the lid of the PIFA and the tuning strips.

47 Claims, 11 Drawing Sheets

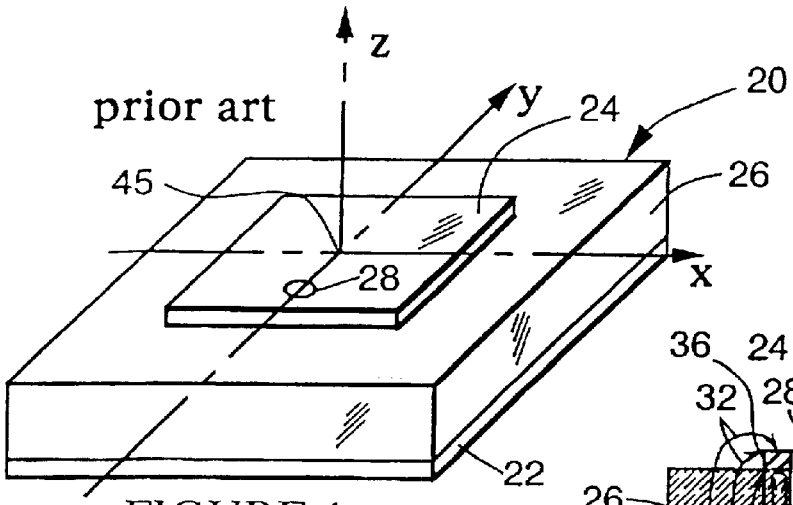
FIGURE 1
FIGURE 2
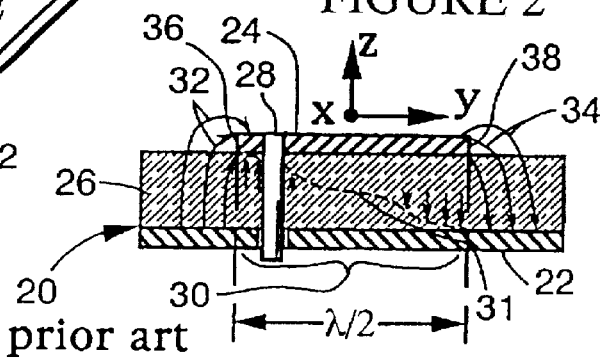
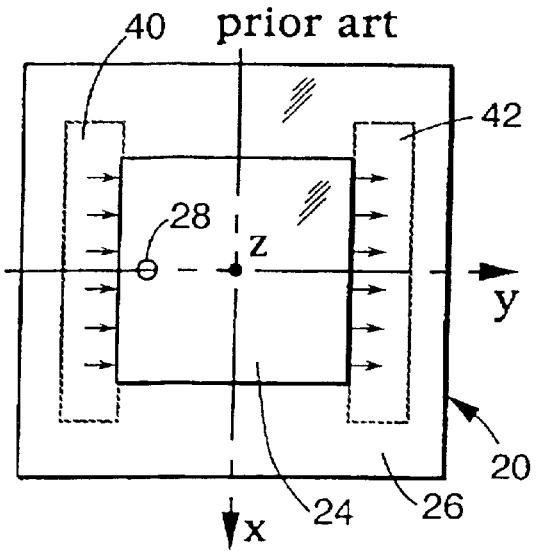
FIGURE 3
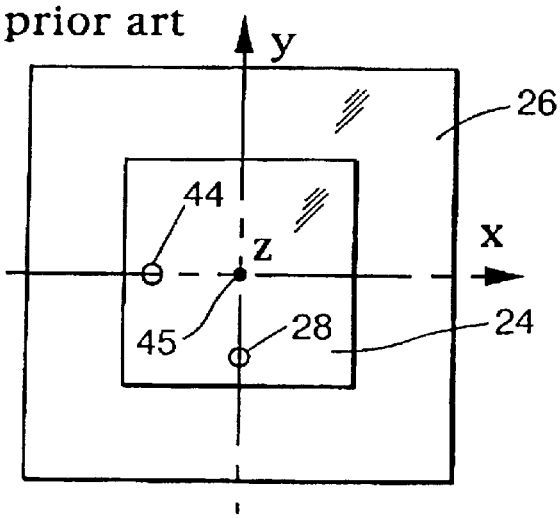
FIGURE 4

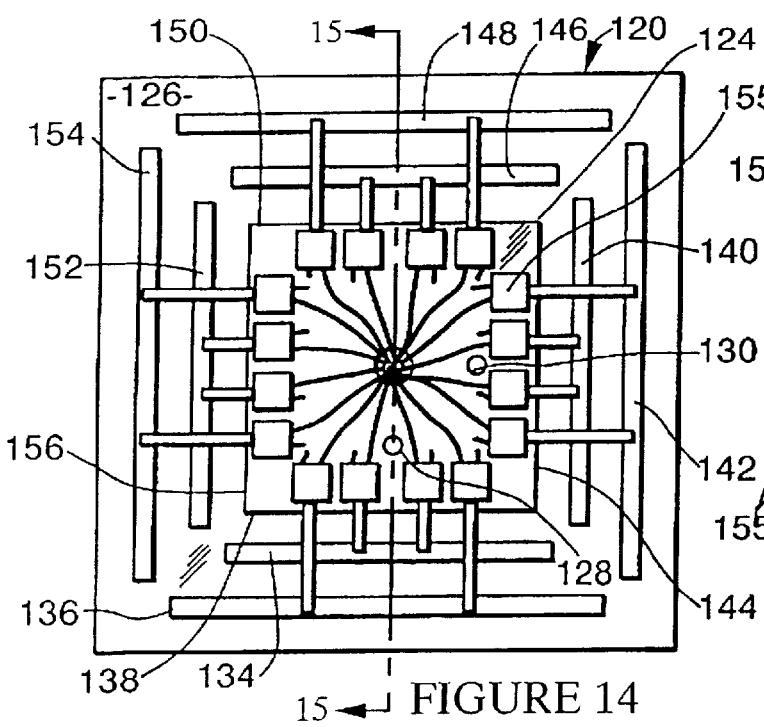
FIGURE 14
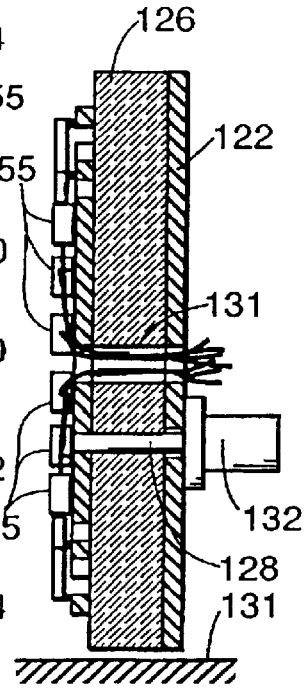
FIGURE 15
FIGURE 16
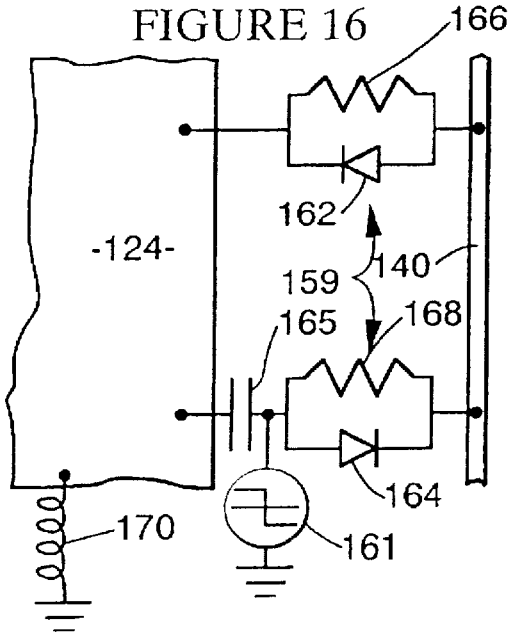
FIGURE 17
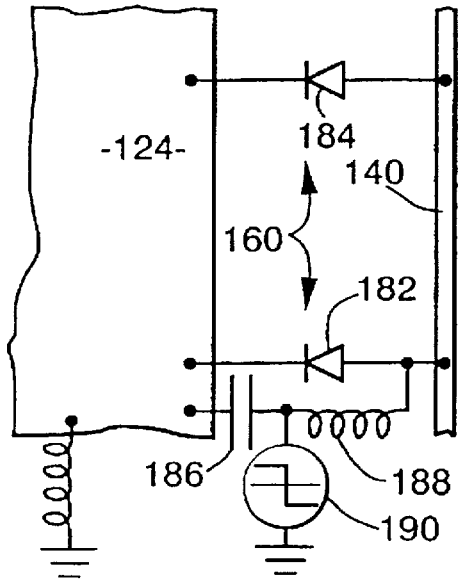

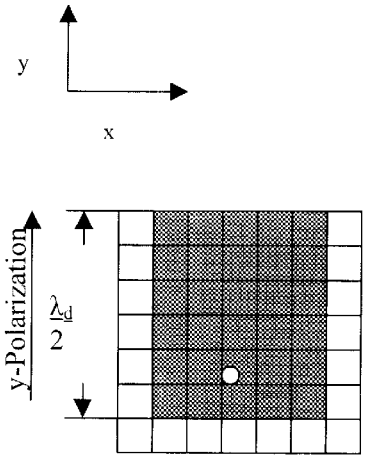
$f=f_o$, $z_{in}=z_o$
FIG. 29B
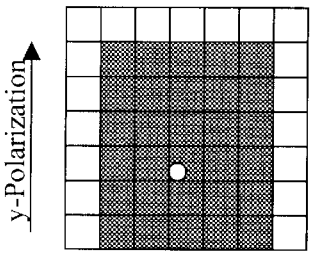
$f=f_o$, $z_{in}>z_o$
FIG. 29C
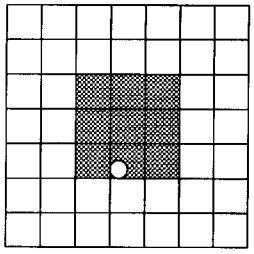
$f>f_o$
FIG. 29D
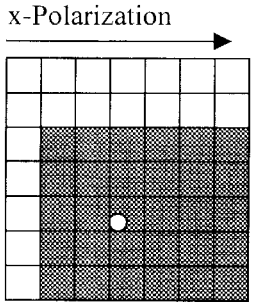
Same frequency and $z_{in}$ as in FIG. 29B, but reconfigured for x polarization
FIG. 29E
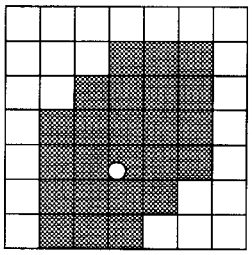
Can produce elliptical or circular polarizations
FIG. 29F
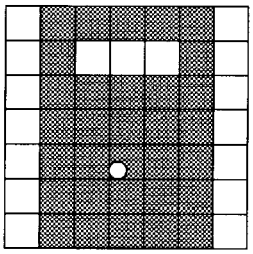
$f<f_o$; elliptical, circular and y-polarizations possible; fine tuning by creation of gaps
FIG. 29G
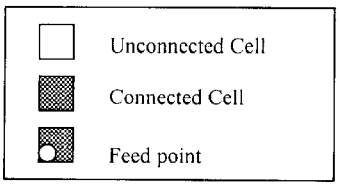

TUNABLE PATCH ANTENNA

BACKGROUND OF THE INVENTION

1. Field of the Invention

The present invention relates to patch antennas, and more particularly, to tunable patch antennas with a patch and switches to one or more tuning strips which when coupled to the patch by the switches adjust the antenna resonant frequency.

2. Description of Related Art

Many applications require small, light weight, efficient conformal antennas. Traditionally microstrip patch antennas have been a preferred type for many applications. These applications tend to be only over a narrow frequency band, since microstrip patch antennas typically are efficient only in a narrow frequency band. Otherwise, the advantages of these antennas of being mountable in a small space, of having high efficiency and of being capable of being constructed in a rugged form, have made them the antennas of choice in many applications.

Satellite communication (Satcom) systems and other similar communications systems require relatively broadband antennas. Typical military broadband applications include long range communication links for smart weapon targeting and real time mission planning and reporting. A variety of antenna designs, such as crossed slots, spirals, cavity-backed turnstiles, and dipole/monopole hybrids have been used for similar applications over at least the last 15 years. However, most of these antennas require large installation footprints, typically for UHF antennas, a square which is two to three feet on a side. When used on aircraft, these antennas intrude into the aircraft by as much as 12 inches and can-protrude into the airstream as much as 14 inches. For airborne Satcom applications, antennas of this size are unacceptably large, especially on smaller aircraft, and difficult to hide on larger aircraft, where it is undesirable to advertise the presence of a UHF Satcom capability. Therefore, there has been a need for small highly efficient broadband or frequency-reconfigurable narrowband antennas, not just in these applications, but in many other new and different commercial applications. For example, one possible application is a multiband multimode mobile phone that operates in the GSM 900 MHz, PCS 1900 MHz, and DES 1800 MHz bands, although not simultaneously.

SUMMARY OF THE INVENTION

A patch antenna is composed of a segmented patch and MEMS switches which are built on a substrate. The patch segments of the segmented patch can be electrically connected to each other by the MEMS switches to form a contiguous patch and optional tuning strips and to permit or block the flow of RF currents between the contiguous patch and the optional tuning strips. When RF is connected between the tuning strips and the contiguous patch, the tuning strips increase the effective length of the contiguous patch and lower the antenna's resonant frequency, thereby allowing the antenna to be frequency tuned electrically over a relatively broadband of frequencies. When the tuning strips are connected to the patch in other than a symmetrical pattern, the antenna pattern of the antenna can be changed. In another aspect of the invention, fine tuning in accordance with desired frequency, input impedance and/or polarization can be achieved by selectively connecting patch segments in reconfigurable patterns using switches. A planar inverted F antenna (PIFA) is also provided with one or more tuning strips spaced from the lid of the PIFA and with switches to connect or block RF between the lid of the PIFA and the tuning strips.

BRIEF DESCRIPTION OF THE DRAWINGS

These and other objects and advantages of the present invention will become apparent to those skilled in the art after considering the following detailed specification, together with the accompanying drawings wherein:

FIG. 1 is a perspective view of a prior art microstrip patch antenna;

FIG. 2 is a cross sectional view taken along the y-axis of FIG. 1.

FIG. 3 is a top plan view of the antenna of FIG. 1 showing the virtual radiating slots thereof;

FIG. 4 is a top plan view of a dual feed embodiment of the antenna of FIG. 1;

FIG. 14 is a top plan view of an antenna constructed according to the present invention, with its switch circuits, leads, and RF feeds;

FIG. 15 is a side cross-sectional view taken at line 15—15 of FIG. 14;

FIG. 16 is a circuit diagram of a switching circuit for connecting and disconnecting a tuning strip to the patch of the present antenna;

FIG. 17 is a circuit diagram of another switching circuit for connecting and disconnecting a tuning strip to the patch of the present antenna;

FIGS. 29B–G illustrate various MEMs connection configurations to reconfigure a TPA, such as the one illustrated in greater detail in FIG. 29A, to achieve both coarse and fine tuning of desired operating frequency, input impedance, and polarization;

DETAILED DESCRIPTION OF THE INVENTION

Figure 5:
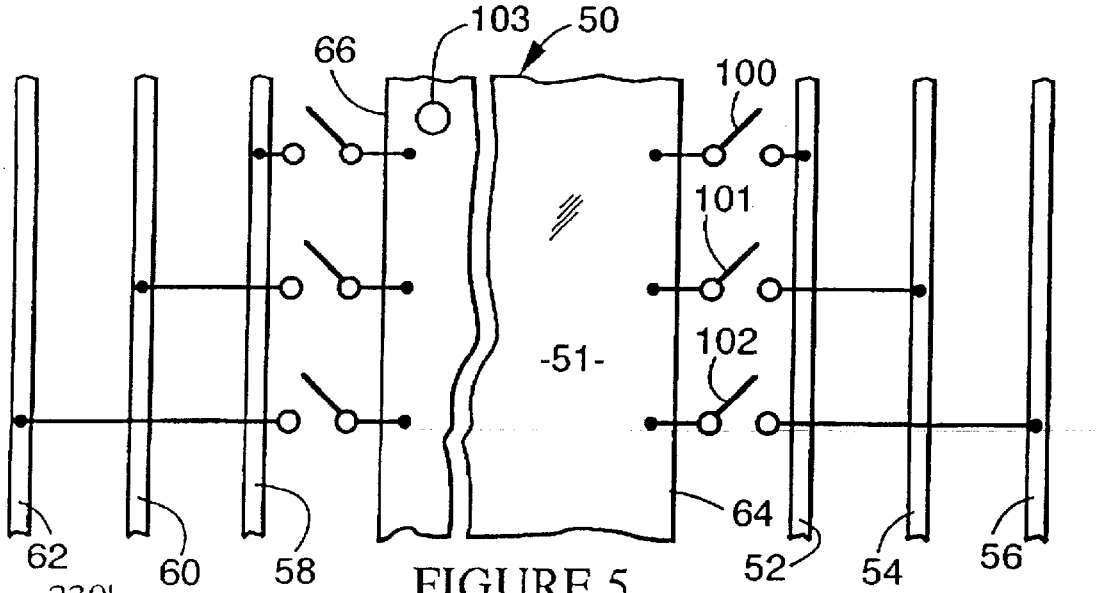
FIG. 5 is a partial diagrammatic plan view of an antenna constructed according to the present invention, showing a switch configuration thereof.

Referring to the drawings more particularly by reference numbers, number 20 in FIG. 1 refers to a prior art patch antenna that includes a conducting ground plane 22, a conducting patch 24 and a dielectric spacer 26 spacing the patch 24 parallel to and spaced from the ground plane 22. Suitable feed means 28 electrically insulated from the ground plane 22, extends therethrough and through the dielectric spacer 26 to feed RF energy to the patch 24. Although the patch 24 is shown as square or rectangular in shape, it is also quite common to have circular patches either center fed or fed adjacent the edge as feed 28 is positioned. For any patch antenna operating in the lowest order mode, $Tm_{11}$ for a circular patch and the order mode $TE_{10}$ for a rectangular patch, a linearly polarized radiation pattern can be generated by exciting the patch 24 at a single feed point such as feed point 28. For antenna 20, which has a square patch that is a special case of a rectangular patch, the patch 24 generates a linearly polarized pattern with the polarization aligned with the y-axis. This can be understood by visualizing the antenna 20 as a resonant cavity 30 formed by the ground plane 22 and the patch 24 with open side walls as shown in FIG. 2. When excited at its lowest resonant frequency, the cavity 30 produces a standing half wave 31 ($\lambda/2$) when operating at the lowest order mode as shown, with fringing electric fields 32 and 34 at the edges 36 and 38 that appear as radiating slots 40 and 42 (FIG. 3). This electric field configuration has all field lines parallel with the y-axis and hence produces radiation with linear polarization. When a feed 44 is located on the x-axis as shown in FIG. 4, all electric field lines are aligned with the x-axis. If two feeds 28 and 44 are present simultaneously, one on the x-axis and the other on the y-axis as shown in FIG. 4, then two orthogonal electric fields are generated. Because the fields are orthogonal, they do not couple or otherwise affect each other and circular polarization results if the feeds are fed at 90° relative phase. With two feeds 28 and 44, four polarization senses can be generated. When feed 44 alone is used, there is linear horizontal polarization. When feed 28 only is used, there is linear vertical polarization. When feeds 28 and 44 are activated with feed 28 90° in phase behind feed 44, then the antenna 20 radiates RF signals with right hand circular polarization. When feed 28 is fed 90° ahead of feed point 44, left hand circular polarization results. Therefore, with two feeds and the ability to switch between them, any of the four polarizations can be generated from a single antenna 20.

As shown in FIG. 2, the maximum electric field is positioned at the edges 36 and 38 of the patch 24 whereas the minimum electric field occurs at the center 45 of the patch 24. At some intermediate positions between the center 45 and the edges of the patch 24, impedances occur that may match the characteristic impedance of the transmission line of feed 28. The feeds 28 and 44 are preferably placed so the impedances perfectly match.

Figure 6:
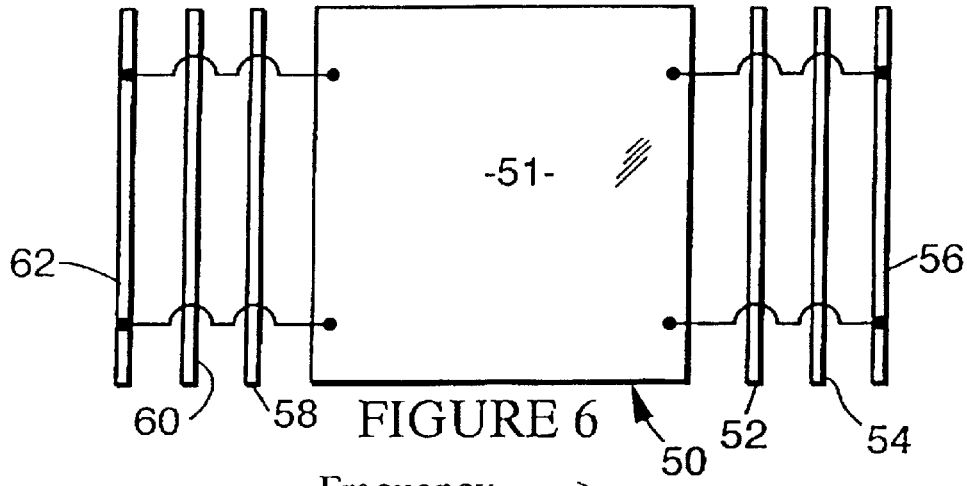
FIG. 6 is a top plan view showing how the tuning strips of an embodiment of the present invention can be connected to the patch thereof.
Figure 7:
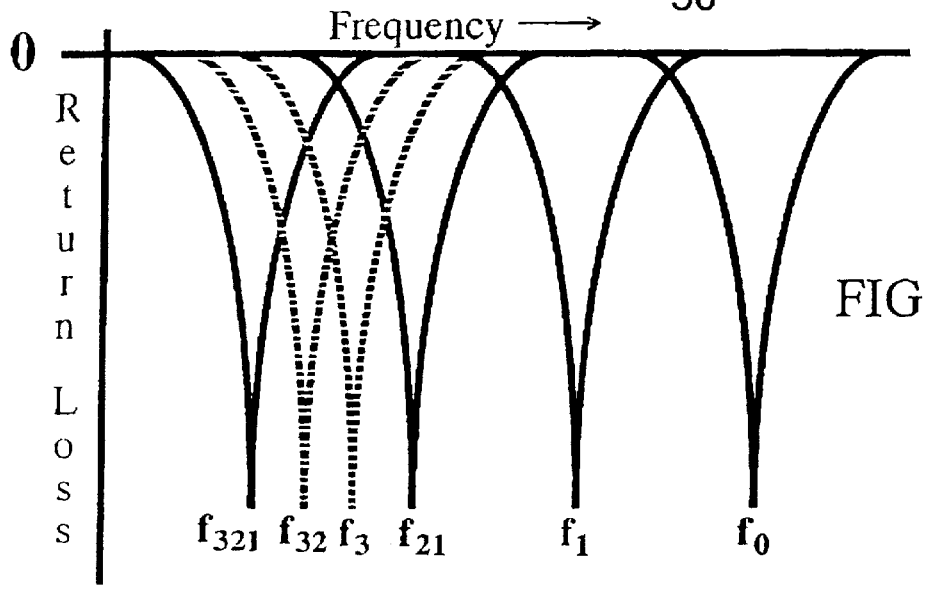
FIG. 7 is a graph of typical Frequency vs. Return Loss for various tuning states of the antenna of FIG. 6, where the frequency subscript designates the particular tuning strips electrically connected to the patch.

A simplified antenna 50 constructed according to the present invention is shown in FIG. 5 with only one polarization shown for simplicity. The antenna 50 and other antennas constructed in accordance with the present invention to be described hereinafter, are shown on a planar ground plane even though all of the present antennas can be curved within reason to conform to curved or compound curved surfaces of air vehicles or other supporting structures on or in which they may be mounted. The antenna 50 includes a patch 51 with three equally-spaced tuning bars or strips 52, 54, 56 and 58, 60 and 62 on opposite sides 64 and 66 of the patch 51 The resonant frequency of the antenna 50 is inversely proportional to the total effective patch length, that is the length of the patch 51 plus any of the strips 52 through 62 connected thereto. Therefore, the highest resonant frequency of the antenna 50 occurs when all of the strips 52 through 62 are disconnected from the patch 51. Possible operating states that can be generated with antenna 50 include $f_{highest}(f_0)$ for just the patch 51, $f_{mid\text{-}high}(F_1)$ for the patch 51 with strips 52 and 58 connected, $f_{highest}(f_{21})$ for the patch 51 with strips 52, 54, 58 and 60 connected and $f_{lowest}(f_{321})$ for the patch 51 with all of the strips 52 through 62 connected. However, the antenna 50 can be used with some of the outermost strips like 56 and 62 connected and the remaining strips disconnected (FIG. 6) to produce an operating frequency $f_3$ somewhat higher than $f_{lowest}(f_{321})$ as shown in FIG. 7, which is a graph of return loss versus frequency. Another possible configuration has the patch 51 connected to strips 54, 56, 60 and 62 but not strips 52 and 58 to produce a frequency $f_{32}$just above $f_{lowest}$. The extra frequencies that are possible by connecting different combinations of strips allow antennas of the present invention to be designed with fewer tuning strips and connecting components, while still providing continuous coverage over the frequency range of interest.

Figure 8:
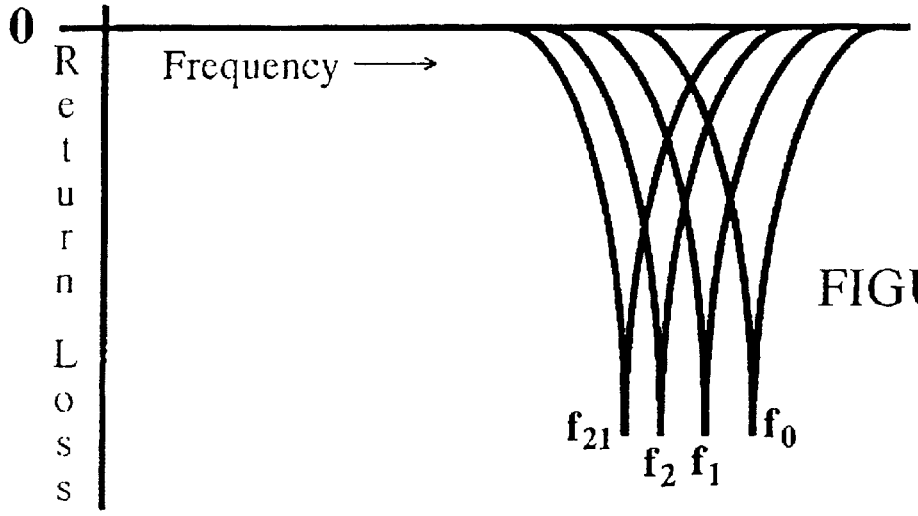
FIG. 8 is a graph of Frequency vs. Return Loss for the antenna of FIG. 9, which can be finely tuned.
Figure 9:
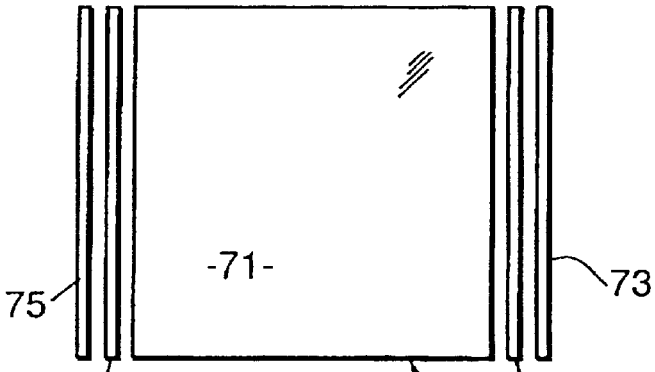
FIG. 9 is a partial top plan view of the tuning strips and patch of an antenna constructed according to the present invention, showing how tuning strips are positioned and spaced when the antenna is to be finely tuned at frequencies near the resonant frequency of the patch alone.
Figure 10:
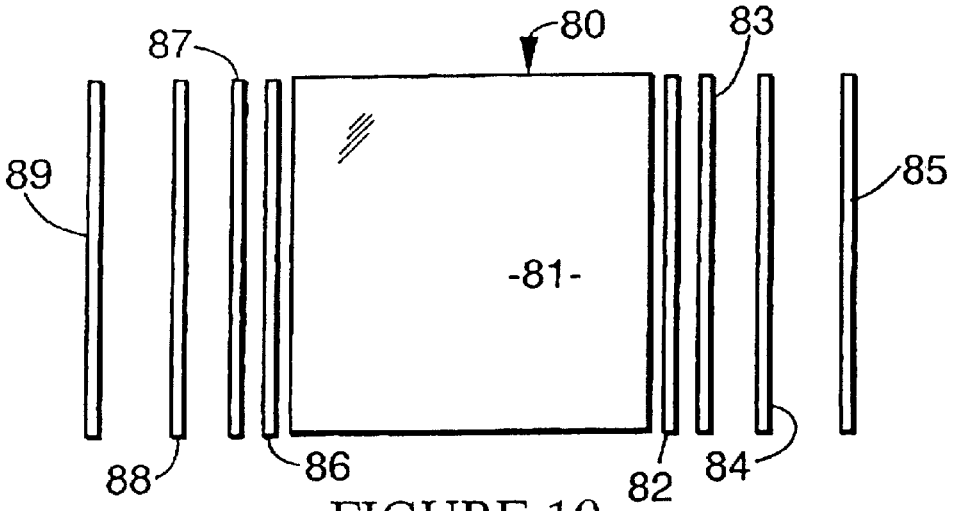
FIG. 10 is a partial top plan view of the tuning strips and patch of an antenna constructed according to the present invention, showing how tuning strips are positioned and spaced when the antenna is to cover a broad RF frequency band.
Figure 11:
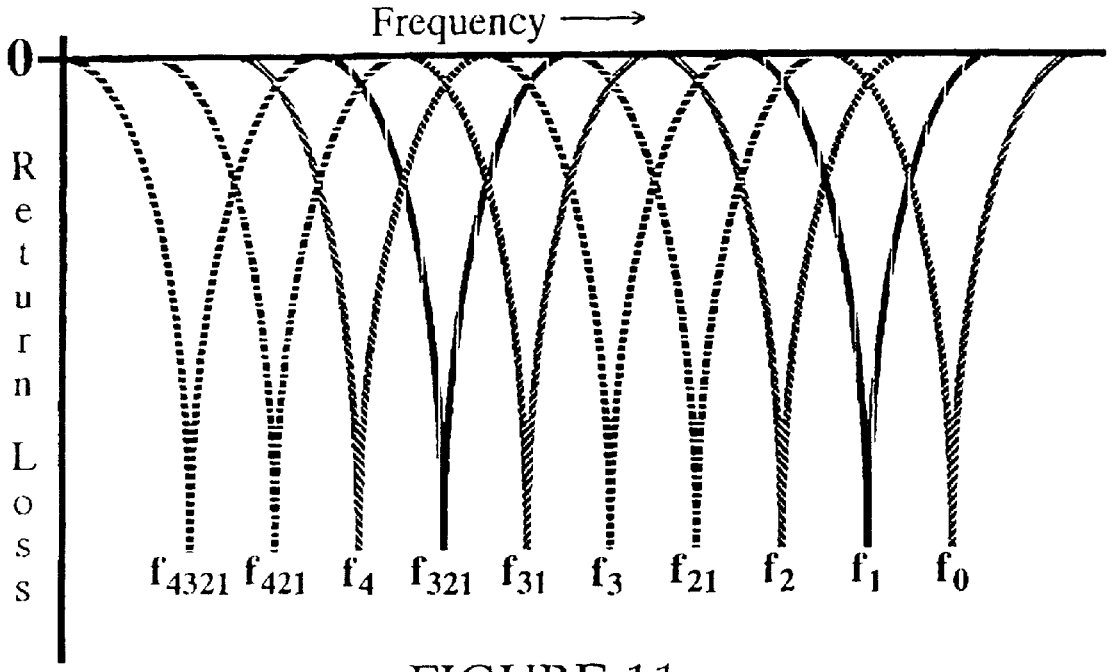
FIG. 11 is a graph of Frequency vs. Return Loss for various tuning states of the antenna of FIG. 10.

The tuning strips do not have to be equally spaced and fewer more widely spaced strips make the present antenna simpler and less costly to build. For the high frequency tuning states that employ only the innermost strips, these extra tuning states are less available. For example, if the frequency coverage shown in FIG. 8 is required, a patch 70 of the antenna 71 with closely spaced tuning strips 72, 73, 74 and 75 can be used (FIG. 9). The strips 72 and 74 must be located sufficiently close to the patch 71 that frequency $f_1$ is generated. Any combination of other strips located further from the patch 71 will generate an operating frequency lower than $f_1$. Similarly, tuning strips 73 and 75 will generate the next lowest frequency $f_2$. Therefore, a broadband design may appear as shown in FIG. 10 by antenna 80, which includes patch 81 and tuning strips 82, 83, 84, 85, 86, 87, 88 and 89. Note the narrow spacing between the patch 81 and the strips 82 and 86 and then that the spacing increases outwardly as shown on FIG. 11, so a relatively even spread of frequencies can be obtained either by using individual strips or combinations, the frequencies being shown with subscript numbers indicating the connected strips counting outwardly from the patch 81. The resonant frequency of patch 81 alone is $f_0$.

Figure 12:
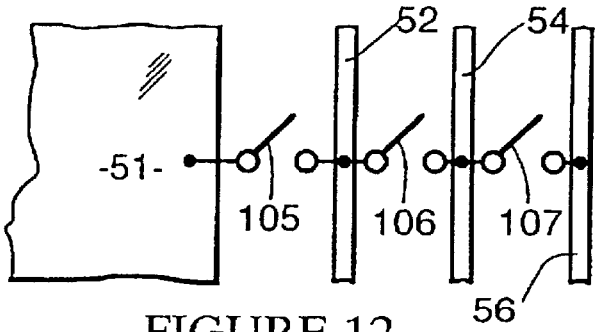
FIG. 12 is a partial diagrammatic plan view of an antenna constructed according to the present invention, showing an alternate switch configuration thereof.
Figure 13:
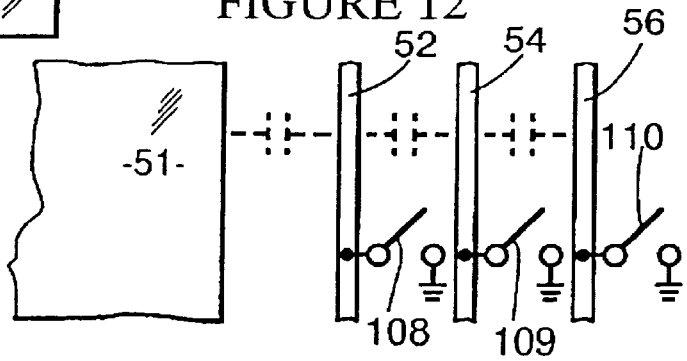
FIG. 13 is a partial diagrammatic plan view of an antenna constructed according to the present invention, showing an alternate switch configuration thereof that grounds the tuning strips rather than connects them to the patch, useful when the strips capacitively couple to the patch.

As shown in FIGS. 5, 12 and 13, the tuning strips 52, 54 and 56 can be coupled to the patch 51 by different switching arrangements. In FIG. 5, switches 100, 101 and 102 connect the tuning strips 52, 54 and 56 in parallel to the patch 51 so that any combination can be connected thereto. If only the strips 52, 54, and 56 are connected to the patch 51, the effect is to move the feed 103 percentage wise closer to the edge 66 to affect the antenna pattern and/or impedance match. In FIG. 12, switches 105, 106, and 107 connect the tuning strips 52, 54 and 56 in series. In this configuration, an interior tuning strip cannot be skipped to tune between what would normally be tuning strip frequencies.

At high frequencies, the strips preferably are positioned very close together because they must be wide enough to carry the RF currents yet located at small distances from the patch. When they are positioned close to the patch, capacitance therebetween is high enough to couple RF between the strips and the patch and make the connection circuitry of FIGS. 5 and 12 ineffective to isolate the strips from the patch. Therefore, as shown in FIG. 13, switches 108, 109 and 110 are connected so they can ground the tuning strips 52, 54 and 56, which otherwise capacitively couple to the patch 51. In some instances, the switch connections of FIG. 13 and either FIGS. 5 or 12 may need to be combined to get desired coupling and decoupling of the strips and the patch.

A microstrip patch antenna 120 constructed according to the present invention, whose thickness is exaggerated for clarity, can be seen in FIG. 14. The antenna 120 includes a conductive ground plane 122 and a square patch 124 supported and insulated from the ground plane 122 by a dielectric spacer 126. The patch 124 is fed by two leads 128 and 130, which are physically positioned at 90° to each other about the center hole 131 (FIG. 15) of the patch 124. When the antenna 120 is transmitting, the leads 128 and 130 connect RF signals that are electrically 90° degrees apart in phase to the patch 124 to produce circular polarization. As previously discussed, this causes the polarization of the antenna 120 to be right hand circular if lead 128 is fed 90° ahead of lead 130. If the phase difference of the leads 128 and 130 is reversed, the antenna 120 produces an output with left hand circular polarization. If the antenna 120 is oriented as shown in FIG. 15 at 90° to the earth 131, and only lead 130 is fed, then the antenna 120 produces an output signal with a linear horizontal polarization. When only lead 128 is feeding the antenna 120, then an output signal with a linear vertical polarization is produced. As shown in FIG. 15, a suitable connector 132 is provided on each of the leads 128 and 130 for connection to RF producing or receiving means, the leads 128 and 130 being insulated or spaced from the ground plane 122, as shown. Note that other connection means may be employed in place of the connector 132, such as microstrip lines, coplanar waveguide, coupling apertures, and the like.

As aforesaid, relatively conventional patch antennas employing a patch 124 above a ground plane 122 and fed as described, are fairly conventional, efficient narrow frequency band devices. To increase the frequency coverage of the antenna 120 without affecting its antenna pattern, operation modes, or polarization, conductive frequency broadening strips are positioned on the spacer 126 parallel to and spaced from the patch 124 with strips 134 and 136 positioned near the lower edge 138 of the patch 124, strips 140 and 142 positioned near the right edge 144 of the patch 124, strips 146 and 148 positioned near the upper edge 150 of the patch 124, and strips 152 and 154 positioned near the left edge 156 of the patch 124.

When the strips 134, 140, 146 and 152 are connected by switch means 155 to the RF frequencies present at the patch 124, they effectively enlarge the patch 124 without changing its shape and thereby lower its resonant frequency. If in addition strips 136, 142, 148 and 154 are also connected to the patch 124, this further lowers the resonant frequency of the antenna 120. Intermediate frequencies can be gained by connecting only strips 136, 142, 148 and 154 to the patch 124 which has the effect of lowering the resonant frequency of the antenna 120 but not so much as if all strips were connected. In addition to changing the resonant frequency, the pattern of the antenna 120 can be changed by connecting the patch 124 to only opposite pairs of strips or connecting only the strips on one edge, adjacent edges or three edges. This allows the antenna pattern to be directed in a chosen direction to reduce an interfering signal near or at the frequency of interest. With the symmetrical antenna 120, in almost every combination, the connecting of the strips adjusts the resonant frequency of the antenna and/or adjusts its radiation pattern. With a non-symmetrical antenna of the present invention, it is difficult to change the resonant frequency without changing the antenna pattern.

Figure 18:
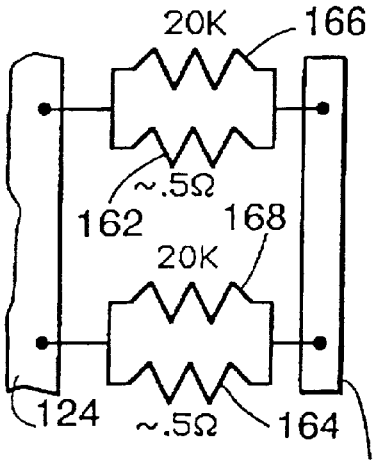
FIGS. 18 and 19 are equivalent circuit diagrams for the switching circuit of FIG. 16 when the circuit is connecting the patch to the tuning strip.
Figure 19:
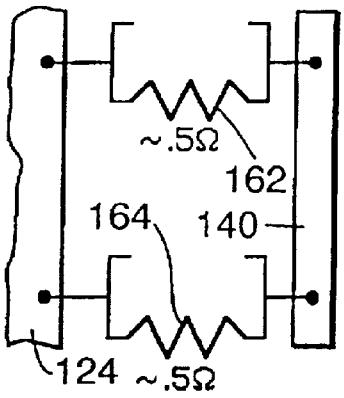
Figure 20:
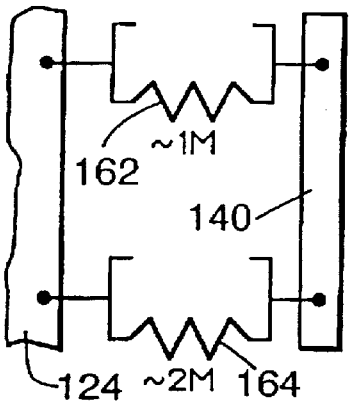
FIGS. 20 and 21 are equivalent circuit diagrams for the switching circuit of FIG. 16 when the circuit is disconnecting the patch from the tuning strip.
Figure 21:
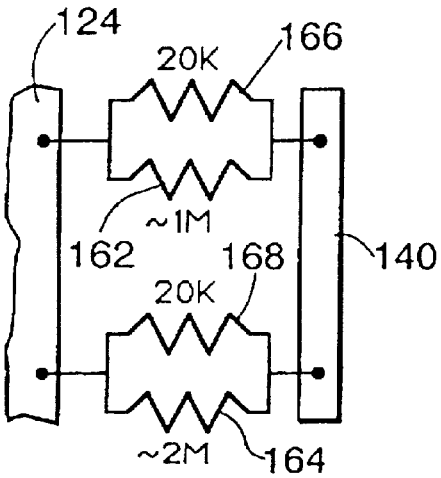

The patch 124 can be connected to the strips 134, 136, 140, 142, 146, 148, 152, and 154 by suitable means such as electronic switches, diodes, field effect transistors (FETs), EM relays and other electronic devices. Preferable circuits 159 and 160 are shown in FIGS. 16 and 17 where PIN diodes are biased to either conduct or not conduct with a DC signal to connect or disconnect a strip to the patch 124. A positive/negative DC power source 161 is used to bias diodes 162 and 164 either into conducting or nonconducting conditions. When both diodes 162 and 164 are biased by a positive current from the power source 161 to conduct, the strip 140 is connected to any RF signal on the patch 124 and acts to expand the length thereof and thus lower the resonant frequency of the patch 124. The RF signal passes through a DC blocking capacitor 165 whose capacitance is chosen to act like a short to RF in the frequency band of interest. The RF signal then passes through the diode 164 (which when forward biased appears as a very low resistance of 0.5Ω), to the strip 140, and through the diode 162 connected between the patch 124 and the strip 140. Balancing resistors 166 and 168 are positioned in parallel to the diodes 162 and 164 respectively. Their resistances are chosen to be relatively high (typically 20 to 500 KΩ). They have no effect when the diodes 162 and 164 are conducting since the impedance of the diodes 162 and 164 is 40,000 times less, the equivalent circuit at RF being shown in FIG. 18. Since the 0.5Ω diodes 162 and 164 are so much lower in impedance than the 20 KΩ resistors 166 and 168, virtually all the RF current flows through the 0.5Ω diodes 162 and 164, and the 20 KΩ resistors 166 and 168 act like open circuits as shown in FIG. 19. However, when the power source 161 reverse biases the diodes 162 and 164, the diodes 162 and 164 present a very high resistance of 1 MΩ or more, as shown in the equivalent circuits of FIG. 20. The circuit is then a voltage divider. If the diodes 162 and 164 are identical in reverse bias impedance, then the resistors 166 and 168 are not needed because an equal voltage drop occurs across each diode 162 and 164. However, economical bench stock diodes can have an impedance difference as much as 1 MΩ. Therefore, as shown in FIG. 20, the diodes 162 and 164 if mismatched, become components in an unbalanced impedance bridge, which might allow a RF signal to appear on the strip 140. With diode 162 having a reverse bias impedance of 1 MΩ and diode 164 having a reverse bias impedance of 2 MΩ, the voltage division created may not be enough to keep diode 162 biased off when RF is fed to the patch 124. The balancing resistors 166 and 168 avoid the problem by greatly reducing the effect of mismatched diodes since the parallel impedance of 1 MΩ diode 162 and 20 KΩ resistor 166 is 19.6 KΩ, whereas the parallel impedance of 2 MΩ diode 164 and 20 KΩ resistor 168 is 19.8 KΩ resulting in an insignificant voltage division of 49.75% to 50.25% across the diodes 162 and 164 respectively. An RF blocking coil 170 is used to complete the DC circuit to the power source 161 without allowing RF to ground out therethrough.

Figure 22:
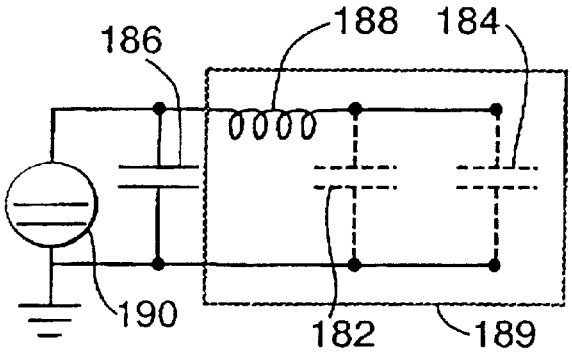
FIG. 22 is an equivalent circuit diagram for the switching circuit of FIG. 17 showing how a tuned filter is formed thereby.

Another connection circuit 160 for connecting the patch 124 to strip 140 utilizing diodes 182 and 184 is shown in FIG. 17 wherein PIN diodes 182 and 184 are connected oriented in the same direction in parallel between the patch 124 and the strip 140 to avoid voltage division there between. The circuit 160 includes a capacitor 186 of a capacitance chosen to be a short circuit at RF frequencies and an open circuit at DC and an inductor 188 chosen such that, when combined with the parasitic capacitances of the diodes 182 and 184, the capacitor 186 and inductor 188 form a parallel resonant circuit 189 (FIG. 22). The series connected capacitor 186 and inductor 188 are fed DC therebetween by a DC power source 190 similar to the source 161, which can provide both positive and negative DC current thereto. The patch configuration is essentially the same for the parallel diode circuit 160 as for the series diode circuit 159 as to patch size, number of strips and strips facing. When forward biased by the power source 190, the diodes 182 and 184 conduct from the strip 140 to the patch 124 in a DC sense, thereby forming a low resistance RF path. The advantage of circuit 160 over circuit 159 is that the resistors 166 and 168 are no longer required because the applied voltage is no longer divided between the two diodes 182 and 184. Also, each diode 182 and 184 is reverse biased by the entire output of the power source 190 as opposed to approximately ½ as in the case of circuit 159. This increases the bias voltage allowing the antenna to handle higher RF power or allows a more economical lower power source 190 to be employed.

Figure 23:
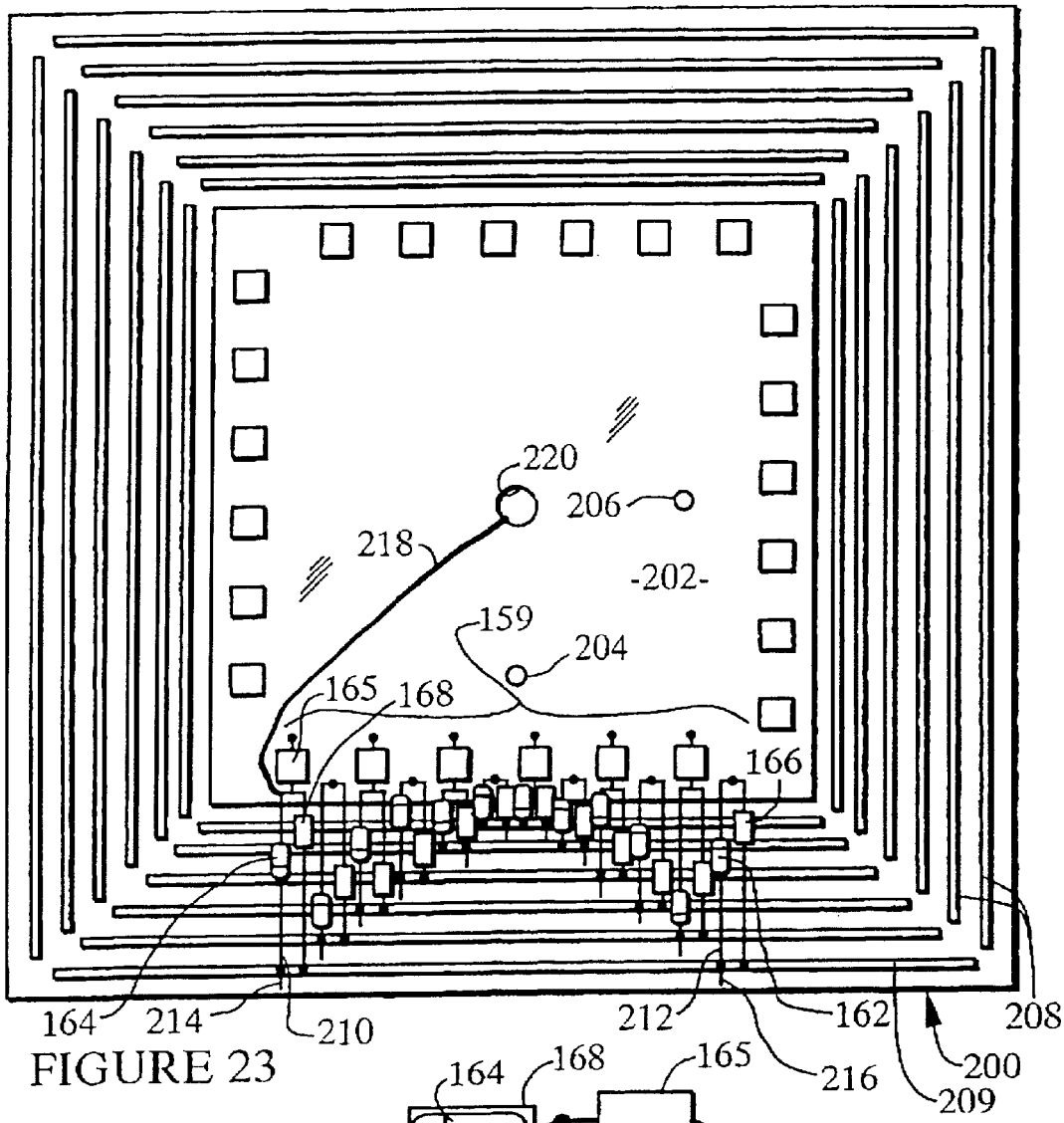
FIG. 23 is a top plan view of a broadband antenna being constructed according to the present invention with some of the switching circuits of FIG. 16 being in place thereon.

The partially constructed antenna 200 of FIG. 23 shows a typical embodiment of the present invention with the switching circuits 159 thereon. Like the aforementioned antennas, antenna 200 includes a patch 202 having feeds 204 and 206 symmetrically positioned at 90° with respect to each other and on the horizontal and vertical axis of the patch 202. A plurality of spaced tuning strips 208 are symmetrically placed around the square patch 202 so that they can effectively increase its size when connected to the patch 202 by the switching circuits 159, one of which switching circuits 159 having the appropriate component numbers indicated, for connecting tuning strip 209 to the patch 202. Note that some of the leads 210 and 212 connecting to the tuning strip 209 extend outwardly beyond the tuning strip 209. The stubs 214 and 216 that result allow fine tuning of the antenna 200 once it has been constructed and can be tested. The stubs 214 and 216 are intentionally made longer than needed and then trimmed off to raise the resonant frequency of the antenna 200 when the strip 209 is connected.

Figure 24:
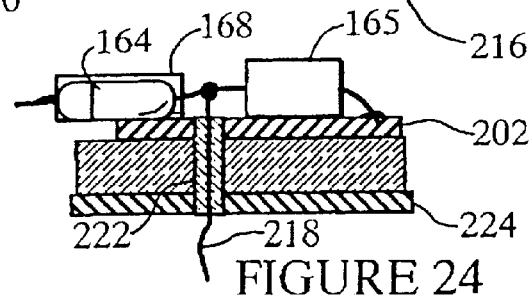
FIG. 24 is an enlarged cross-sectional view of an alternate arrangement to form the switching circuit of FIG. 16 on the antenna of FIG. 23.

The tuning circuits 159 are connected to the power source 161 by suitable leads, such as lead 218, which is shown extending through a center orifice 220 included for that purpose. As shown in FIG. 24, the lead 218 can also be fed through an insulator 222 that extends through the ground plane 224 and the patch 202 to connect to the capacitor 165, the diode 164 and the resistor 168. The lead 218 could also be an insulated plated-through hole.

As the patch 202 is effectively enlarged by the addition of tuning strips with similar enlargement of the electric field standing wave (see FIG. 2), when the patch is enlarged uniformly, the impedance matches of the feeds 204 and 206 change. The original construction of the antenna 200 can be compromised for this by positioning the feeds 204 and 206 toward the strips so that a perfect impedance match occurs when some of the strips are connected symmetrically, or the strips can be connected asymmetrically so that as the effective patch size of the antenna increases, the effective center of the patch shifts away from the feed to keep its impedance matched. Additional strips 208 on the opposite edge from the feeds 204 and 206 can also be added so that strips can be asymmetrically added over the entire frequency band of the antenna. Which method is used for feed impedance matching in some measure depends on the ability of the connected transmitter or receiver to tolerate antenna feed mismatch and physical constraints that might prevent additional strips on sides opposite from the feeds 204 and 206. Whether any correction for impedance match changes is needed depends on the bandwidth being covered. Experiments have shown that no correction is required for the Satcom band discussed above.

Figure 25B:
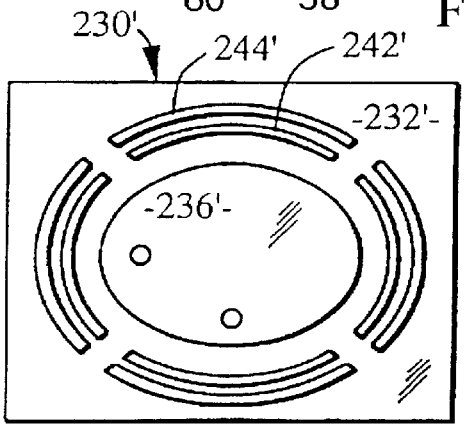
FIG. 25B is a top plan view of a modified version of the antenna of FIG. 25A with an oval patch and segmented concentric tuning strips.
Figure 25A:
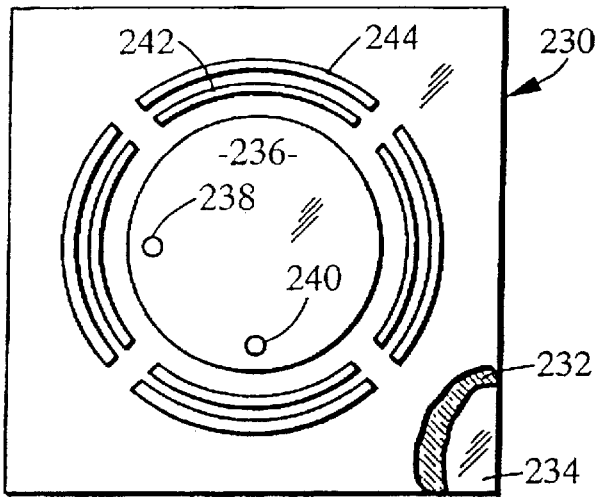
FIG. 25A is a top plan view of an antenna constructed according to the present invention with a two feed circular patch and segmented concentric tuning strips.
Figure 26:
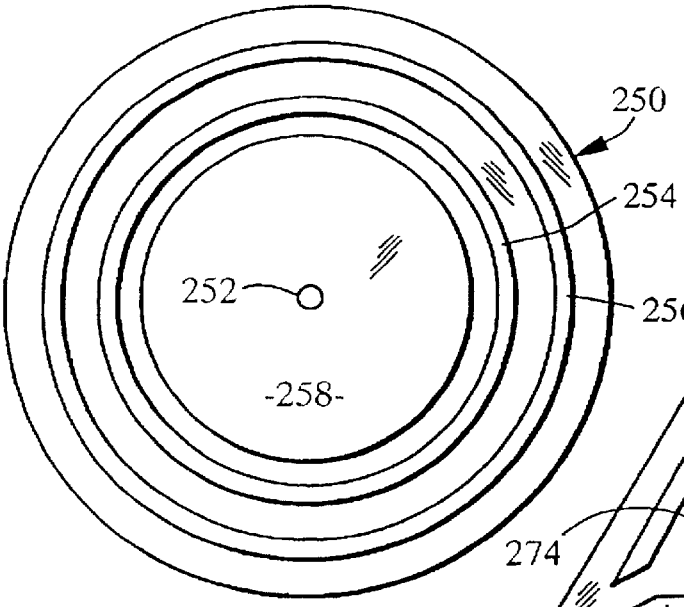
FIG. 26 is a top plan view of an antenna constructed according to the present invention with a center fed circular patch and concentric tuning strips.

Although the invention has been described primarily with square patch antennas, other shapes are possible. For example, in FIG. 25A, a circular antenna 230 is shown mounted over a square dielectric spacer 232 and ground plane 234. The antenna 230 includes a circular patch 236 with two feeds 238 and 240 for polarization control as in the square patch antennas previously described. Two rings of segmented concentric tuning strips 242 and 244 are used to lower the resonant frequency of the antenna 230. FIG. 25B shows a similar antenna 230' where the patch 236' and rings of segmented tuning strips 242' and 244' are oval, showing that the shape of the patches 236 and 236' can be said to be shaped as a plane section of a right circular cone. Another configuration of a circular antenna 250 including the present invention is shown in FIG. 26. The antenna 250 has a central feed 252 and concentric tuning rings 254 and 256 surrounding the patch 258. The antenna 250 therefore has no means to vary the polarization or the antenna pattern, the tuning rings 254 and 256 only being useful in reducing the resonant frequency of the antenna 250.

Figure 27:
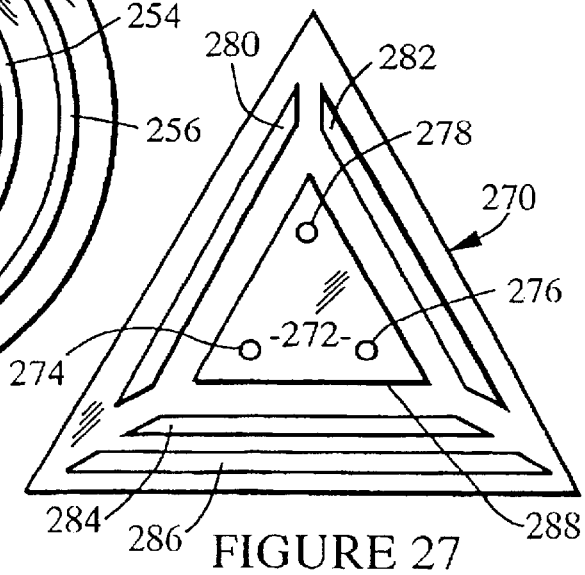
FIG. 27 is a top plan view of an antenna constructed according to the present invention with a triple feed triangular patch and uneven numbers of tuning strips spaced from the edges of the patch.

As shown in FIG. 27, almost any configuration of patches and tuning strips can be employed for special purposes. The antenna 270 of FIG. 27 includes a triangular patch 272 with three feeds 274, 276 and 278 positioned in the corners thereof. The feeds 274, 276 and 278 can be fed out of phase or fed all in the same phase so that they act like a center feed. Note that the upper sides of the triangular patch 272 have associated single tuning strips 280 and 282 while two tuning strips 284 and 286 are provided at the lower edge 288. This configuration would be used if low frequencies are only required with a directed antenna pattern.

Figure 28:
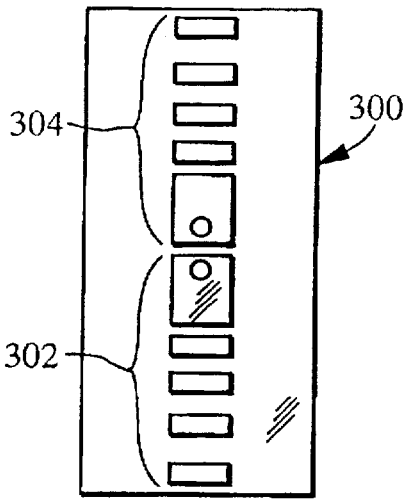
FIG. 28 is a top plan view of a pair of antennas elements constructed according to the present invention positioned back-to-back to form a frequency tunable dipole antenna.

The antenna 300 shown in FIG. 28 is essentially two of the present antennas 302 and 304 positioned back-to-back to form a tunable dipole antenna 300.

Figure 29A:
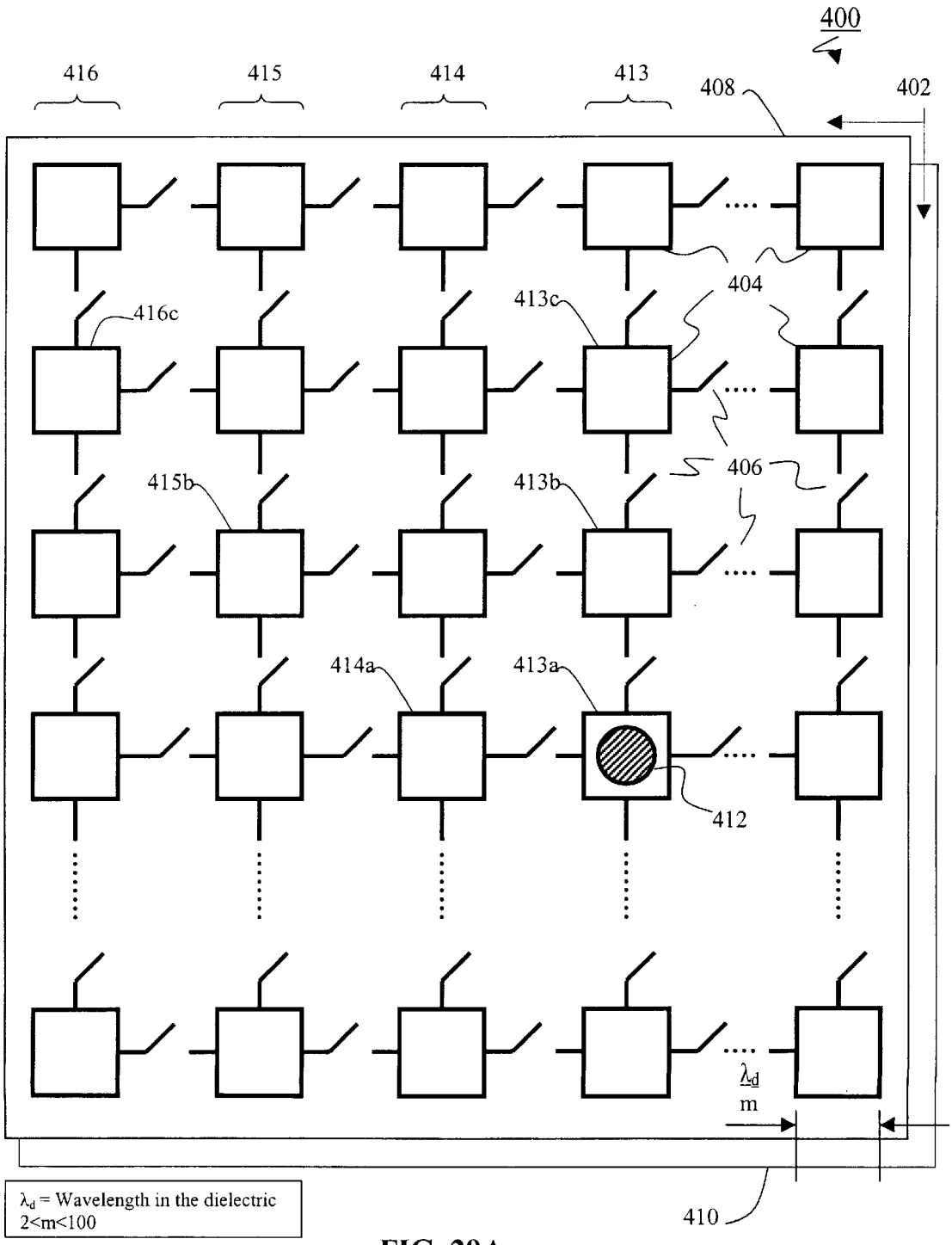
FIG. 29A illustrates an integrated patch antenna with MEMS switches.

FIG. 29A illustrates an integrated patch antenna with MEMS switches in accordance with certain aspects of the invention. As shown in FIG. 29A, antenna 400 includes segmented patch 402 composed of a grid or array of conducting (metallic) plates 404 which are connected to each other for communicating RF energy therebetween by a system of MEMS switches 406 which are fabricated on the same substrate 408 as plates 404. Substrate 408 can be a semiconductor or other material, including circuit-board material such as alumina. Substrate 408 is disposed over a ground plane 410. A coaxial or microstrip feedpoint 412 terminates on one of the plates 404 and thereby provides a feed for RF energy to the antenna 400. In order to not obscure the invention, the control lines and the bias lines to the switches are not shown. With suitable means of addressing and controlling the individual MEMS switches, using techniques adapted from U.S. Pat. No. 6,061,025, for example, the integrated plates and switches of antenna 400 can be connected together to produce patch antennas of various sizes and shapes, to control antenna resonant frequency, polarization, input impedance, and to some degree antenna pattern shape.

It should be noted that the drawing in FIG. 29A is not necessarily to scale, particularly with respect to the size of the MEMS switches versus the plate size, separation between plates, etc. According to an aspect of the present invention for providing fine tuning of various parameters, however, the plate size is very small with respect to the wavelength of the desired antenna application, such as 1/10 to 1/100 of wavelength (i.e. $\lambda_d$, or wavelength in the dielectric). Certain aspects of such fine tuning will be described hereinbelow.

While the plates 404 shown in FIG. 29A are of equal size, it should be appreciated that in alternative embodiments plates 404 can be of unequal size. For example, the length of each plate may depend on its distance from the center of the segmented patch. Additionally, while only one feedpoint is shown in FIG. 29A, it should be appreciated that in alternative embodiments there can be two or more feedpoints. For example, a dual polarized antenna can be constructed with antenna 400 that has two feed points.

While the plates 404 shown in FIG. 29A are in the shape of a square or rectangle, it should be appreciated that in alternative embodiments plates 404 can have arcuate or angular shapes such that structures such as those in FIG. 25A, FIG. 25B, FIG. 26, FIG. 27 can be constructed by appropriately turning on switches.

It should be noted that, with appropriate control, certain of plates 404 can be coupled to non-adjacent plates. In this regard, although FIG. 29A shows all the plates being capable of being coupled to only adjacent plates using switches 406, constructing connectors to provide interconnection and bias lines at different layers in a substrate is well understood in the art of semiconductor processing and need not be described here.

From this observation, it should be appreciated that the plates can be coupled together using switches 406 to make both a patch from a fraction of the plates and tuning strips displaced from the patch using certain of the remaining fraction of the plates. For example, plate 413*a* can be coupled to plate 414*a* and the plates in column 414 can be connected to each other to form the outer edge of a patch or alternatively plate 413*a* and the other plates in column 413 can be connected to each other to form the outer edge of a patch. For example, plate 413*b* can be coupled to plate 415*b* via an appropriate connector. Further, plate 413*c* can be coupled to plate 416*c* via an appropriate connector. In this manner, plates can singly or in pairs be used for fine control. Alternatively, various numbers of plates in column 415 can be coupled together or various numbers of plates in column 416 can be coupled together.

While in the description provided above, the patch and the tuning strips have straight edges, it should be appreciated that patches and tuning strips that are roughly arcuate in shape are encompassed by the teachings of this invention. For example, a patch can be in the general shape of a circle or an ellipse or some other curved shape. A tuning strip can be in the general shape of a ring or arcuate segments.

FIGS. 29B–G illustrate various MEMs connection configurations to reconfigure a TPA, such as the one illustrated in greater detail in FIG. 29A, to achieve both coarse and fine tuning of desired operating frequency, input impedance, and polarization. FIGS. 29B and 29C illustrate that the input impedance of an antenna is affected by the distribution of patches around the feed point. For example, as shown in FIG. 29C, a row of patches further away from the feed point is not connected to the patches that are connected to the feed point, causing the impedance to increase relative to the configuration in FIG. 29B where a row of patches near the feed point is not connected to the patches that are connected to the feed point.

In FIG. 29D the operating frequency is increased relative to the configurations in FIGS. 29B and 29C by decreasing the size of the antenna (i.e., decreasing the number of patches connected to the feed point).

FIG. 29E illustrates that the polarization may be changed by changing the dominant direction in which the patches are distributed relative to the feed point. It should be appreciated that the patches connected to the feed point are distributed more along the x-axis, resulting in a corresponding polarization in the x direction for the dominant mode. The operating frequency and input impedance are the same as in the configuration described in connection with FIG. 29B, but the polarization is in the x direction.

FIG. 29F illustrates an asymmetrical distribution of connected patches around the feed point. Consequently, an elliptical polarization results. It should be appreciated that a circular polarization is also possible and that many other possible configurations are possible.

FIG. 29G illustrates a technique for fine tuning both operating frequency and polarization by creating gaps or slots. By selectively disconnecting patches so as to create a gap or slot within a patch network, the operating frequency can be raised or lowered relative to the original network. Further, fine tuning of polarization in the y direction is also achieved. This technique can be used with any of the preceding FIGS. 29B–F.

Figure 30:
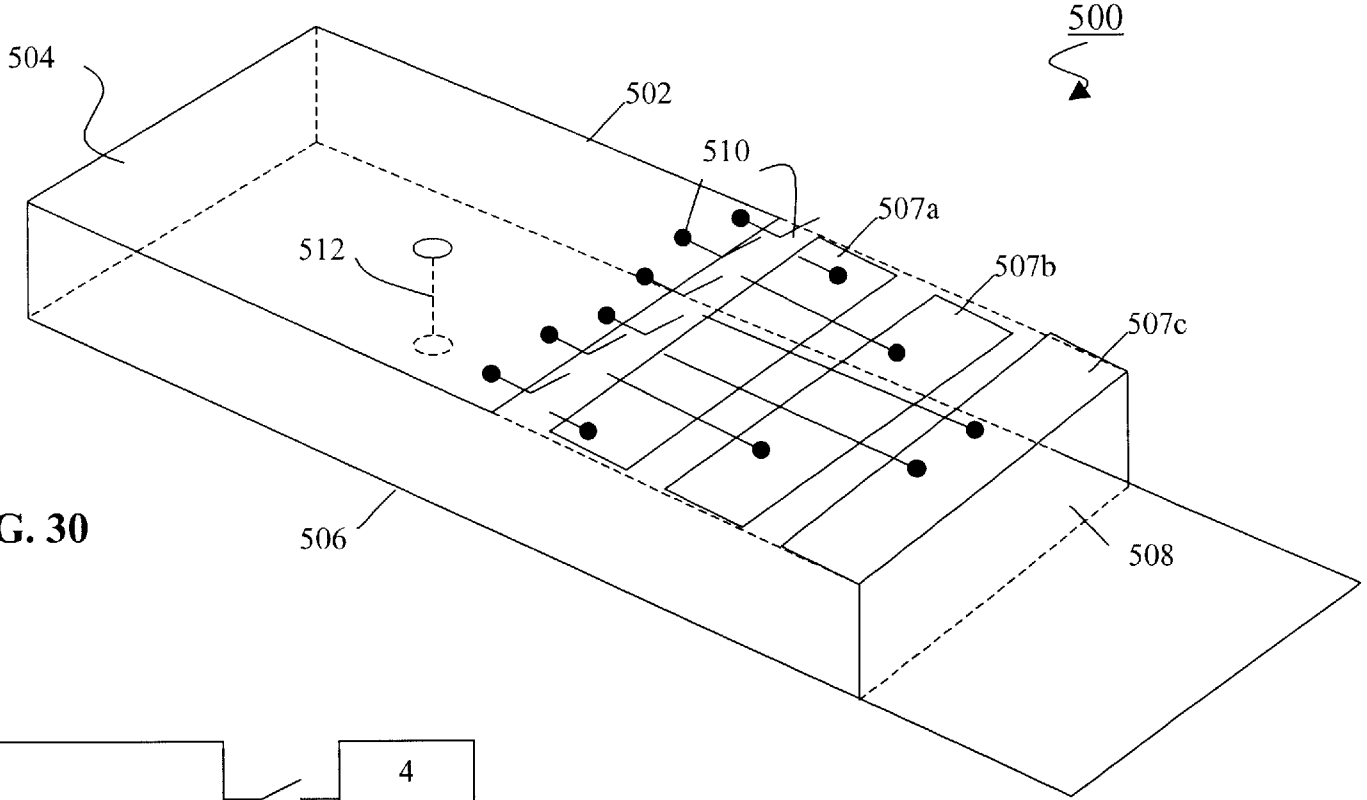
FIG. 30 illustrates a tunable planar inverted F antenna (PIFA)

FIG. 30 illustrates a tunable planar inverted F antenna (PIFA) according to certain other aspects of the present invention. As shown in FIG. 30, antenna 500 includes a PIFA lid 502, a shorting wall 504, a ground plane 506, and tuning strips 507*a*, 507*b*, and 507*c*. RF energy is fed into antenna 500 through feed 512. The direction of the dominant mode electric field is from ground plane 506 up to PIFA lid 502, and standing waves run the length of the lid 502, between shorting wall 504 and radiating aperture 508. One of ordinary skill in the art would understand that the PIFA lid, shorting wall and feed can be together considered a radiating element, but a PIFA is typically used with a truncated ground plane, not much larger than the lid, in which case, the whole combination is the radiating element.

It should be noted that FIG. 30 shows a shorting wall 504 that is coextensive with the patch or lid 502 for coupling the lid to the ground plane 506, thereby permitting the resonant frequency of the antenna to be reduced without increasing the antenna size. However, other alternatives to the shorting wall 504 shown in FIG. 30 are possible. For example, the wall need not be the same length as the edge of the lid to which it is coupled. As another example, the shorting element may be comprised of a plated through hole or via through the antenna dielectric layer that acts as a shorting pin between the lid and the ground plane.

Referring back to FIG. 30, switches 510 can selectively connect one or more of tuning strips 507*a*, 507*b*, and 507*c* to lid 502, increasing the length of lid 502 and decreasing the resonant frequency of antenna 500. Switches 510 components include PIN diodes, FETs, bulk switchable semiconductors, relays, mechanical switches, and microelectromechanical systems (MEMS) switches as described herein.

While in the description provided in connection with FIG. 30, lid 502 is a solid patch and the tuning strips each comprise a single solid segment, it should be appreciated that in an alternative embodiment, lid 502 and tuning strips 507*a*–507*c* can be constructed in accordance with the description provided in connection with FIG. 29A where a segmented patch is used to make both a patch and a tuning strip. In a further alternative using patch segments, in place of a shorting wall, a shorting pin comprised of a via or plated through hole can be coupled between the ground plane and an arbitrary one of the patch segments.

Figure 31:
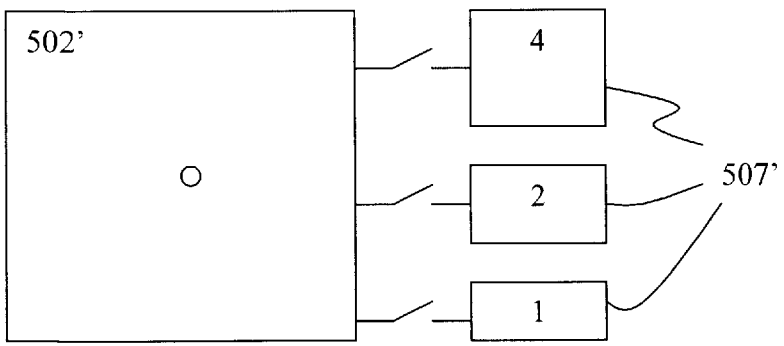
FIG. 31 illustrates a PIFA antenna with digitally related capacitive tuning bars.

It should be further noted that, although the tuning strips 507 in FIG. 30 are shown as being the same size, the invention is not limited thereto, and strips of different sizes are possible. FIG. 31 illustrates a top view of an alternative embodiment of a PIFA antenna such as that shown in FIG. 30. In this example, PIFA lid 502' is coupled to tuning strips 507' by respective switches. In this example, the tuning strips 507' are digitally-related capacitive tuning bars, comprised of n conducting patches of sizes and positions such that $2^n$ tuning states can be created by selecting and connecting the patches in accordance with a digital word. For example, 3 patches of relative areas 1, 2, and 4 (as shown in FIG. 31) (i.e. a first patch has a relative size of 1, another patch has a relative size of 2 times that of the first patch, and a third patch has a relative size of 4 times the first patch) may enable 8 tuning states corresponding to switch states "000" through "111," where a "1" is a closed switch. For this, the smallest patch is selected to create a first small frequency shift, the next larger patch creates a larger shift, and the combination of these two results in an even larger shift, and so on. This arrangement provides certain additional advantages over the previously described tuning strips, such as simplified tuning and control.

Thus, there has been shown and described novel antennas which fulfill all of the objects and advantages sought therefor. Many changes, alterations, modifications and other uses and application of the subject antennas will become apparent to those skilled in the art after considering the specification together with the accompanying drawings. All such changes, alterations and modifications which do not depart from the spirit and scope of the invention are deemed to be covered by the invention which is limited only by the claims which follow.

What is claimed is:

1. An antenna including:

a ground plane that is electrically conductive;

a segmented patch that is divided into patch segments and that is electrically conductive;

a plurality of MEMS switches disposed between the patch segments;

a dielectric layer positioned between said segmented patch and said ground plane; and a RF lead connected to one of the patch segments, none of the other patch segments being coupled to any other RF lead, wherein the MEMS switches couple at least two of the patch segments together for communicating RF energy therebetween including the one of the patch segments connected to the RF lead and wherein no other patch segrnent receives RF energy unless it is one of the coupled at least two patch segments.

2. The antenna as defined in claim 1 wherein the at least two patch segments are disposed along an axis with certain other of the patch segments in between them.

3. The antenna as defined in claim 1, wherein the patch segments have a substantially rectangular shape, the antenna has a desired wavelength, and the side of each rectangular patch segment is substantially less than 1/20 of the desired wavelength.

4. The antenna as defined in claim 1, wherein the patch segments are coupled to achieve a desired resonant frequency for the antenna.

5. The antenna as defined in claim 1, wherein the patch segments are coupled to achieve a desired input impedance to the antenna.

6.The antenna as defined in claim 1, wherein the patch segments are coupled to achieve a desired polarization for the antenna.

7. An antenna including:

a ground plane that is electrically conductive having a first side surface;

a segmented patch that is divided into patch segments and that is electrically conductive, said patch segments having collectively a first side surface and outer boundaries that define four rectilinear edges;

a dielectric layer positioned between said patch segments and said ground plane, said dielectric layer including:

a first side surface in contact with said first side surface of said patch segments; and a second side surface in contact with said first side surface of said ground plane;

an RF lead connected to one of the patch segments, none of the other-patch segments being coupled to any other RF lead; and a plurality of MEMS switches to individually electrically connect and disconnect RF energy from the RF lead among said patch segments, whereby one or more of a resonant frequency, a feed impedance, and a polarization of said antenna can be changed.

8. The antenna as defined in claim 7 wherein the patch segments are spaced from each other by distances that increase in accordance with increasing distances of said patch segments from a point within the segmented patch, and wherein said first and second side surfaces of said dielectric layer are parallel.

9. The antenna as defined in claim 7 wherein each of the patch segments have lengths that increase in accordance with a corresponding increase in a distance of patch segments from a point within the segmented patch.

10. An antenna including:

a ground plane that is electrically conductive having a first side surface;

a segmented patch that is divided into patch segments and that is electrically conductive, said segmented patch being shaped as a segmented plane section of a right circular cone and having:

an outer boundary defined by the outer edges of the outermost patch segments of the segmented patch; and a first side surface;

a dielectric layer positioned between said first patch and said ground plane, said dielectric layer including:

a first side surface in contact with said first side surface of said segmented patch; and a second side surface in contact with said first side surface of said ground plane;

a plurality of spaced ring shaped tuning strips that are electrically conductive and that are positioned concentric to each other and said outer boundary of said segmented patch on said first side surface of said dielectric layer;

an RF lead connected to one of said patch segments, none of the other patch segments being coupled to any other RF lead; and MEMS switches to individually-electrically connect and disconnect RF energy from the RF lead between said patch segments and said plurality of spaced ring shaped tuning strips, whereby a resonant frequency of said antenna can be changed.

11. The antenna as defined in claim 10 wherein said plurality of spaced ring shaped tuning strips are formed in arcuate segments, said switch means controllably electrically connecting and disconnecting RF energy between said arcuate segments of said tuning strips and said patch segments, whereby a resonant frequency and an antenna polarization of said antenna can be changed.

12. An antenna including:

a ground plane that is electrically conductive;

a first segmented patch that is divided into first patch segments and that is electrically conductive having:

at least one outer boundary;

means to electrically insulate and space said ground plane from said first segmented patch;

a plurality of tuning strips that are electrically conductive spaced from said at least one outer boundary of said first segmented patch and said ground plane;

an RF, lead connected to one of said first patch segments, none of the other patch segments being coupled to any other RF lead; and a plurality of MEMS switches to individually electrically connect and disconnect RF energy from the RF lead among said tuning strips and said first patch segments.

13. The antenna as defined in claim 12 wherein said segmented patch is a planar patch oriented on a patch plane parallel to said ground plane, and said plurality of conductive tuning strips are positioned on said patch plane.

14. The antenna as defined in claim 12, further comprising:

a center hole through said first patch, said ground plane, and said means to electrically insulate and space said ground plane from said first patch; and lines that pass through said center hole for supplying a voltage to said plurality of MEMS switches.

15. The antenna as defined in claim 12, wherein said plurality of tuning strips correspond to a plurality of frequencies covering a desired frequency band.

16. An antenna including:

ground plane that is electrically conductive;

a first segmented patch that is divided into first patch segments and that is electrically conductive, said first segmented patch having an outline that is rectilinear and having:

four linear edges;

means to electrically insulate and space said ground plane from said first patch;

an RF lead connected to one of said first patch segments, none of the other patch segments being coupled to any other RF lead; and a plurality of MEMS switches to individually electrically connect and disconnect RF energy from the RF lead between said first patch segments, whereby a resonant frequency of said antenna and an antenna polarization thereof can be changed.

17. The antenna as defined in claim 16, wherein a fraction of said first patch segments are to be coupled by said MEMS switches into a contiguous patch driven by the RF lead.

18. The antenna as defined in claim 17 wherein another fraction of said first patch segments are adapted to be coupled together by said MEMS switches into tuning strips which are spaced from each other by a distance that increases in accordance with increasing distances of said tuning strips from said contiguous patch.

19. The antenna as defined in claim 17 wherein another fraction of said first patch segments are adapted to be coupled together by said MEMS switches into tuning strips which have lengths that increase in accordance with a corresponding increase of a distance of said tuning strip from said contiguous patch.

20. The antenna as defined in claim 16 wherein a fraction of said first patch segments are adapted to be coupled together by said MEMS switches into a contiguous patch driven by the RF lead.

21. The antenna as defined in claim 20, wherein another fraction if said first patch segments are adapted to be coupled together by said MEMS switches into a plurality of spaced ring shaped tuning strips that are alectrically condutive and that are positioned concentric to each other and said contiguous patch.

22. The antenna as defined in claim 21 wherein said plurality of spaced ring shaped tuning strips are formed in segments, said plurality of switches controllably electrically connecting and disconnecting RF energy between said segments of said tuning strips and said contiguous patch, whereby a resonant frequency and a polarization of said antenna can be changed.

23. An antenna including:

a ground plane that is electrically conductive;

a first segmented patch that is divided into first patch segments and that is electrically conductive, said first segmented patch being shaped as a plane section of a right circular cone;

means to electrically insulate and space said ground plane from said first segmented patch;

an RF lead connected to one of said first patch segments, none of the other patch segments being coupled to any other RF lead;

a plurality of MEMS switches to individually electrically connect and disconnect RF energy from the RF lead among said first patch segments, whereby a resonant frequency of said antenna can be changed.

24. In an antenna that includes a ground plane that is electrically conductive, a segmented patch that is divided into patch segments and that is electrically conductive and having at least one boundary, means to electrically insulate and space the ground plane from the patch, an RF lead connected to the segmented patch, none of the other patch segments being coupled to any other RF lead, and a plurality of MEMS switches to individually electrically connect and disconnect RF energy from the RF lead between respective ones of the tuning strips and the patch, the patch supporting a resonance at a first RF frequency, a fraction of said patch segments are coupled by said MEMS switches into a contiguous patch, the contiguous patch having at least one boundary, a plurality of conductive tuning strips spaced from the at least one boundary of the contiguous patch and the ground plane, a method of operation including the steps of:

placing RF energy on the RF lead at a second RF frequency below the first RF frequency; after connecting RF energy to at least one of the tuning strips positioned and dimensioned with respect to the contiguous patch so that the contiguous patch and the connected at least one tuning strip together have a resonant frequency that is about the second RF frequency.

25. The method as defined in claim 24 wherein said connecting step includes:

connecting RF energy to at least two of the tuning strips and blocking RF energy from at least one of the tuning strips, said at least one blocked tuning strip being positioned between at least one of the at least two tuning strips and the contiguous patch.

26. The method as defined in claim 24 wherein the contiguous patch has at least two edges and a plurality of tuning strips spaced from each edge, said connecting step including:

connecting RF energy to more tuning strips spaced from one edge than the other to change a polarization of the antenna.

27. The method as defined in claim 24 wherein the RF lead is connected to the patch nearer to the at least one edge than an opposite edge, said connecting step including:

connecting RF energy to more tuning strips spaced from the opposite contiguous patch edge than to tuning strips spaced from the at least one contiguous patch edge so as to adjust an impedance match between the RF lead and the antenna.

28. The method as defined in claim 24 wherein another fraction of said patch segments are coupled by said MEMS switches into a plurality of conductive tuning strips.

29. The method as defined in claim 28 wherein said connecting step includes:

connecting RF energy to at least two of the tuning strips and blocking RF energy from at least one of the tuning strips, said at least one blocked tuning strip being positioned between at least one of the at least two tuning strips and the contiguous patch.

30. The method as defined in claim 28 wherein the RF lead is connected to the patch nearer to the at least one edge than an opposite edge, said connecting step including:

connecting RF energy to more tuning strips spaced from the opposite contiguous patch edge than to tuning strips spaced from the at least one contiguous patch edge so as to adjust an impedance match between the RF lead and the antenna.

31. The method as defined in claim 24 wherein the contiguous patch has at least two edges and a plurality of tuning,strips spaced from each edge, said connecting step including:

connecting RF energy to more tuning strips spaced from one edge than the other to change a polarization of the antenna.

32. An antenna comprising:

a patch that is adapted to receive RF energy and that has a first edge;

a shorting element coupled to the patch;

an electrically conductive ground plane coupled to the shorting element;

a plurality of n tuning strips that are electrically conductive spaced from said first edge of said patch and spaced from said ground plane, each of said n tuning strips having a respective size;

an RF lead connected to said patch; and at least one switch to electrically connect and disconnect RF energy between said at least one turning strip and said patch, wherein $n \geqq 2$ and each of said n tuning strips is connected to said patch by way of an associated one said at least one switch, wherein $2^n$ tuning states are available by selecting and connecting the at least n tuning strips.

33. The antenna as defined in claim 32 wherein said at least one switch includes at least one diode.

34. The antenna as defined in claim 32 wherein said at least one switch includes at least one MEMS switch.

35. The antenna as defined in claim 32 wherein the shorting element is comprised of a wall that is coupled at a first end to a second edge of the patch parallel to and opposite from the first edge and to the ground plane at a second end.

36. The antenna as defined in claim 35 wherein the patch, shorting element and ground plane define a resonator having a radiating aperture.

37. The antenna as defined in claim 35, wherein the first end of the wall is coextensive with the second edge of the patch.

38. The antenna as defined in claim 32, wherein the shorting element is comprised of a plated through hole.

39. An antenna comprising:

a segmented patch divided into patch segments;

a shorting element coupled to at least one of the patch segments;

an electrically conductive ground plane coupled to the shorting element;

an RF lead connected to one of the patch segments of said segmented patch, none of the other patch segments being coupled to any other RF lead; and switches to electrically connect and disconnect RF energy from the RF lead between said patch segments.

40. The antenna as defined in claim 39 wherein a fraction of the patch segments are electrically connected by the switches into a contiguous patch having a first edge.

41. The antenna as defined in claim 40, wherein another fraction of the patch segments are electrically connected by the switches into at least one tuning strip that is electrically conductive spaced from said first edge of said contiguous patch and spaced from said ground plane.

42. The antenna as defined in claim 40 wherein the switches electrically connects the at least one tuning strip to the contiguous patch.

43. The antenna as defined in claim 42, wherein said at least one tuning strip includes at least n tuning strips and $n \geqq 2$ and each of said at least n tuning strips is connected to said patch by way of an associated one said at least one switch, wherein $2^n$ tuning states are available by selecting and connecting the at least n tuning strips.

44. The antenna as defined in claim 39, wherein the shorting element is comprised of a wall that is coupled at a first end to an edge of the patch and to the ground plane at a second end.

45. The antenna as defined in claim 44, wherein the patch, shorting element and ground plane define a resonator having a radiating aperture.

46. The antenna as defined in claim 44, wherein the first end of the wall is coextensive with the edge of the patch.

47. The antenna as defined in claim 39, wherein the shorting element is comprised of a plated through hole.

* * * * *